US006083016A

United States Patent [19]

Waynick, Sr.

[11] Patent Number: 6,083,016

[45] Date of Patent: Jul. 4, 2000

[54] ELECTRICAL CONNECTOR PROTECTIVE DEVICE

[76] Inventor: William C. Waynick, Sr., 6621 Calle De La Cereza, Hereford, Ariz. 85615

[21] Appl. No.: 09/170,429

[22] Filed: Oct. 13, 1998

[51] Int. Cl.[7] ..... H01R 13/44

[52] U.S. Cl. ..... 439/135

[58] Field of Search ..... 439/35, 135, 136, 439/148, 149, 521

[56] References Cited

U.S. PATENT DOCUMENTS

| | | | |
|---|---|---|---|
| 2,545,762 | 3/1951 | Brown | 206/728 |
| 3,251,020 | 5/1966 | Coleman | 439/892 |
| 3,258,731 | 6/1966 | Still et al. | 439/36 |
| 4,333,698 | 6/1982 | Herbert | 439/36 |
| 4,676,569 | 6/1987 | Lambert et al. | 174/52.3 |
| 4,902,238 | 2/1990 | Iacobucci | 439/135 |
| 4,944,685 | 7/1990 | Schulte | 439/135 |
| 5,017,740 | 5/1991 | Honkomp et al. | 174/152 GM |
| 5,147,219 | 9/1992 | Gilberts et al. | 439/521 |
| 5,178,551 | 1/1993 | Bach | 439/133 |
| 5,525,073 | 6/1996 | Sampson | 439/521 |
| 5,573,412 | 11/1996 | Anthony | 439/133 |
| 5,601,460 | 2/1997 | Shimirak et al. | 439/521 |
| 5,722,854 | 3/1998 | Geisler | 439/528 |
| 5,746,611 | 5/1998 | Brown | 439/135 |
| 5,766,020 | 6/1998 | Hughes | 439/35 |

*Primary Examiner*—Khiem Nguyen
*Assistant Examiner*—Brian S. Webb
*Attorney, Agent, or Firm*—Rhodes & Mason, PLLC

[57] ABSTRACT

A protective cover for a standard multiple-pin electrical connector receptacle of the type used to connect a trailer and a prime mover vehicle, the receptacle having a generally cylindrical body having at least one longitudinally extending orientation key protruding outwardly from the cylindrical body and a generally flat end having multiple electrical connecting elements recessed therein and an additional terminal protruding therefrom. The cover is comprised of a cup-shaped housing having an open end and a closed end and a cylindrical wall therebetween, the cylindrical wall having an inner surface and an outer surface, the diameters of the inner surface of the cylindrical wall and the cylindrical body being so related so that when assembled a friction fit exists therebetween to provide the principal means for retaining the cover in assembled relation to the receptacle. There is a longitudinally extending slot in the inner surface of the cylindrical wall of the housing for receiving the orientation key when the cover is assembled with the receptacle.

4 Claims, 4 Drawing Sheets

ELECTRICAL CONNECTOR PROTECTIVE DEVICE

FIELD OF THE INVENTION

The present invention relates generally to standard electrical connector receptacles used to electrically interface between a prime mover vehicle, such as a car or truck, and a towed vehicle, such as a trailer. More particularly, the present invention relates to a unitary, molded plastic protective cover for electrical connector receptacles which, when the receptacle is not engaged with the associated plug, provides protection to the receptacle from environmental conditions.

BACKGROUND OF THE INVENTION

The general idea of protecting disengaged electrical connectors and receptacles from environmental conditions is well known. Prior art solutions typically have focused on providing either a friction fit cover or a cover for wall mounted receptacles with rather complex locking means. None of the prior art solutions, however, address the problem of a protective cover for standard multiple-pin electrical connector receptacles of the type used in towing operations. Thus, there remains a need for a simple, inexpensive cover that will provide protection from environmental conditions for such standard electrical connector used in towing operations when the receptacle is disengaged for the associated plug.

SUMMARY OF THE INVENTION

Generally, the present invention is a protective cover for a standard, multiple-pin electrical connector receptacle of the type used to connect a trailer and a prime mover vehicle, wherein the receptacle includes a generally cylindrical body having at least one longitudinally extending orientation key protruding outwardly from the cylindrical body and a generally flat end having multiple electrical connecting elements recessed therein and an additional terminal protruding therefrom. The cover is essentially a cup-shaped housing having an open end and a closed end and a simple cylindrical wall therebetween. The cylindrical wall has an inner surface and an outer surface. The diameters of the inner surface of the cylindrical wall and the cylindrical receptacle body are so related so that when assembled a friction fit exists therebetween. A longitudinally extending slot in the inner surface of the cylindrical wall of the housing receives the orientation key when the cover is assembled with the receptacle. The cover further includes a plurality of the spaced tabs adjacent to the open end of the housing and extending outwardly from the outer surface of the cylindrical wall for aiding in the assembly and disassembly of the cover and the receptacle. There is preferably a hole in at least one of the plurality of space tabs for attaching a tether. One end of the tether is connected to the tab of the cup-shaped housing and the other end is connected in any convenient manner to the trailer to maintain the receptacle above the ground and out of the mud and dirt. The cover may further include a recess protruding outwardly from the closed end of the housing for receiving the additional protruding terminal of the receptacle when the cover is assembled with the receptacle.

It is the primary object of the present invention to provide a cover for a standard electrical connector receptacle used in towing operations that will provide protection from environmental conditions when the receptacle is disengaged from the associated plug.

It is another object of the present invention to provide an electrical connector receptacle cover that is simple in design and therefore easily manufactured in a reasonably inexpensive manner, is reliable in use, and is easily manipulated as part of the normal cover to receptacle mounting procedures to effect its secure retention thereto.

These and other aspects of the present invention will become apparent to those skilled in the art after a reading of the following description of the preferred embodiment when considered with the drawings.

DETAILED DESCRIPTION OF A PREFERRED EMBODIMENT

Figure 1:
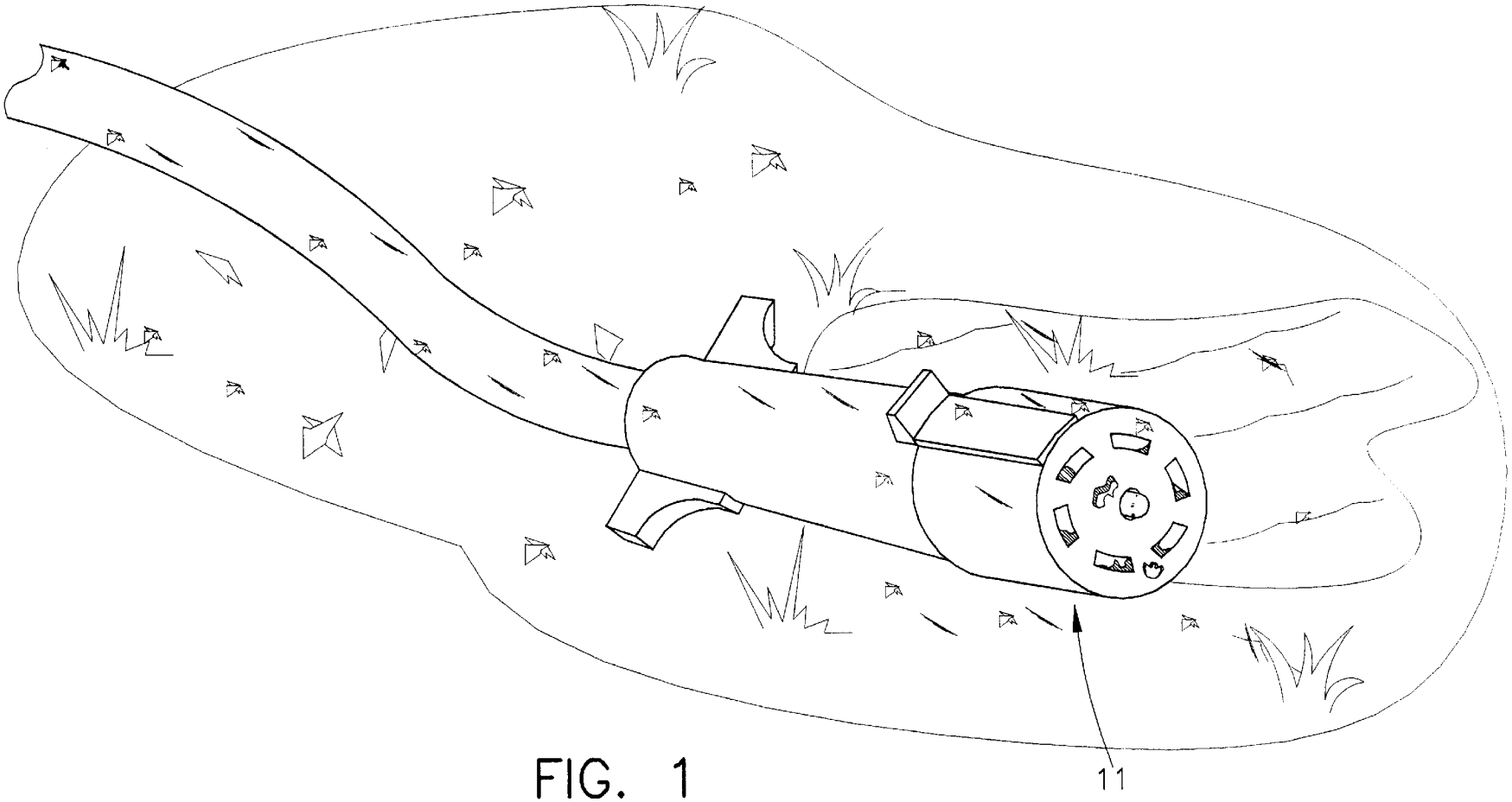
FIG. 1 is an environmental view illustrative of the problem, namely, a disengaged, multiple-pin type electrical connector receptacle being exposed to environmental conditions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. FIG. 1 illustrates the problem of an exemplary standard multiple-pin electrical connector receptacle 11 that is disengaged from the associated plug and is exposed to environmental conditions. Such exposure to environmental conditions can result in moisture entering the metal recesses of the receptacle 11 and corroding the recesses, and/or the accumulation of debris in the recesses of the receptacle 11, either of which can cause a failure of the receptacle 11 when engaged with the associated plug.

Figure 2:
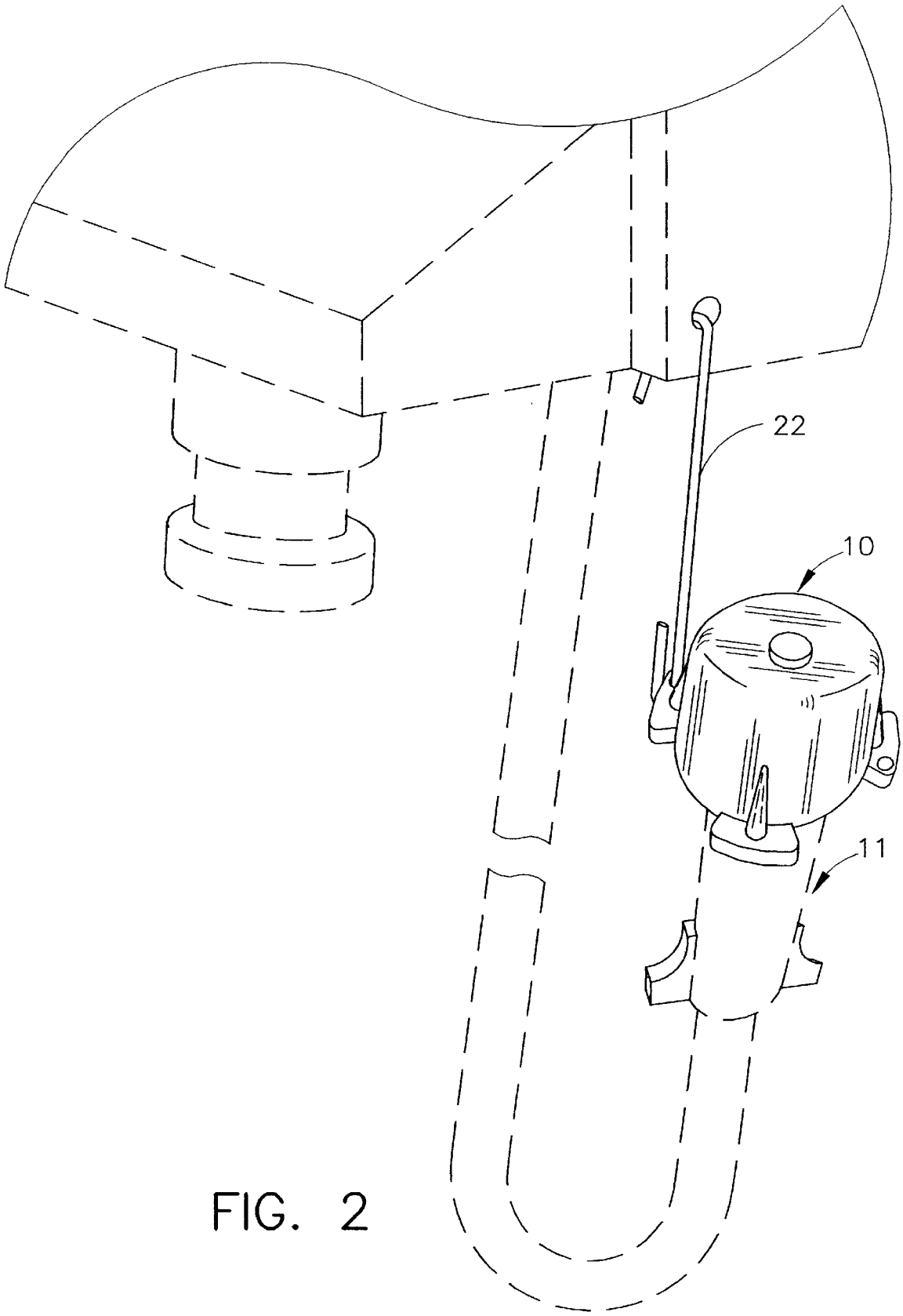
FIG. 2 is a perspective view of a multiple-pin type electrical connector receptacle having a protective cover in accordance with the present invention.
Figure 3:
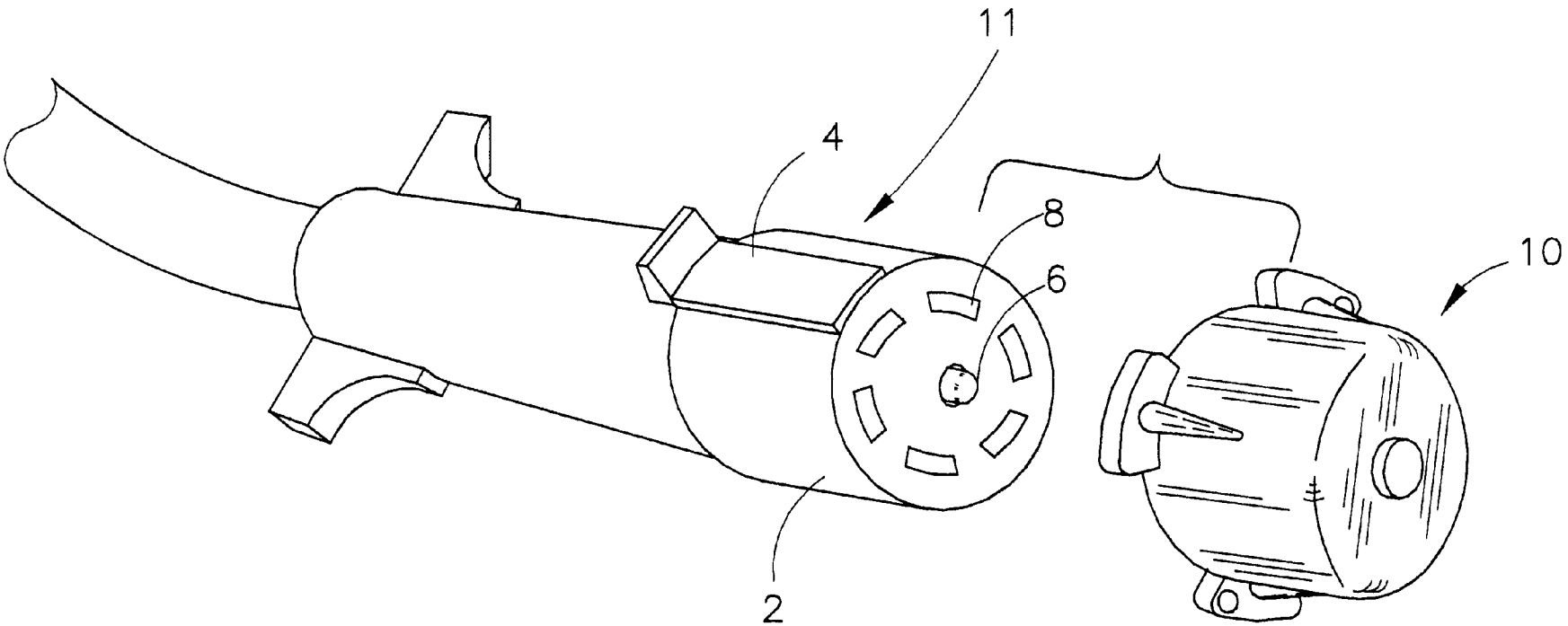
FIG. 3 is an exploded perspective view illustrating the manner in which the protective cover fits onto the receptacle.

FIGS. 2 and 3 show the preferred embodiment of the protective cover 10 in association with the exemplary receptacle 11. The exemplary connector or receptacle 11 is of a type available from Joseph Pollack Corporation of Boston, Mass. as Trailer End Plug Model Nos. 12-702 and 12-706. The receptacle 11 has a generally cylindrical body 2 with a flat end containing a plurality of spaced recesses 8 for receiving the corresponding pins of the associated electrical plug. An additional terminal 6 is provided that protrudes outwardly from the flat end of the body 2 and is for an auxiliary electrical circuit. A longitudinally extending orienting key 4 on the body 2 is provided for correctly orienting the alignment of the spaced recesses 8 with the corresponding pins of the associated electrical plug when the plug is inserted into the receptacle 11. The receptacle 11 is a standard electrical component known in the art, and is not, per se, part of the present invention. Other conventional connectors and receptacles of this general type may include more or less pins and recesses, but are included within the scope of the invention.

A tether 22 is provided for suspending the cover 10 about the ground when the cover is assembled with the electrical connector receptacle 11.

Figure 4:
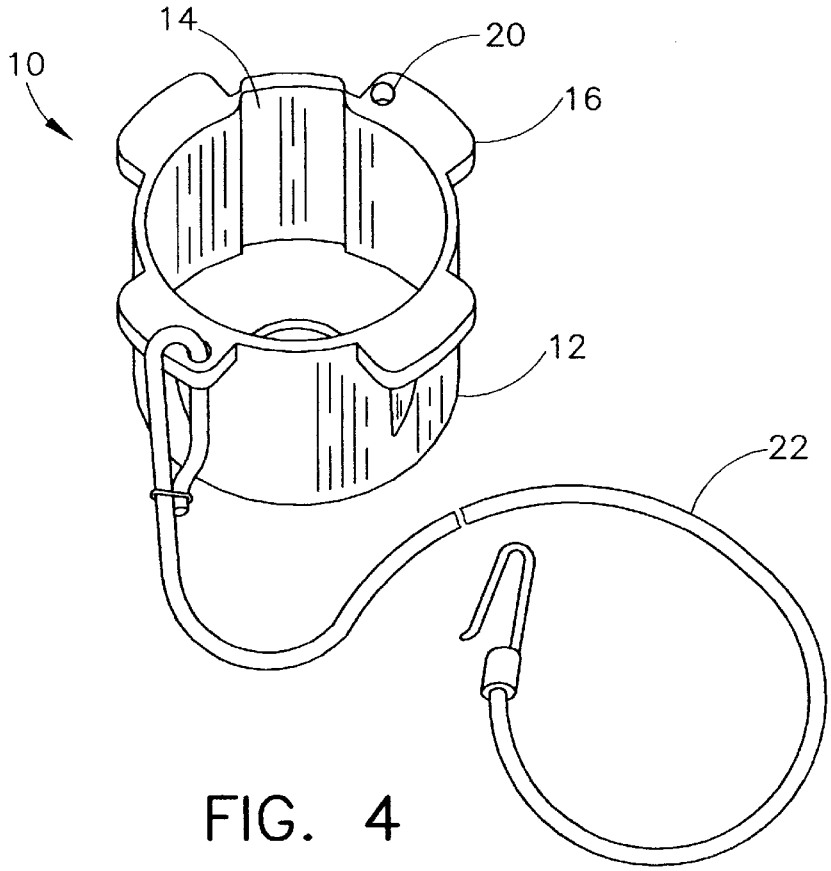
FIG. 4 is a perspective view of the protective cover of the present invention illustrating the interior.
Figure 5:
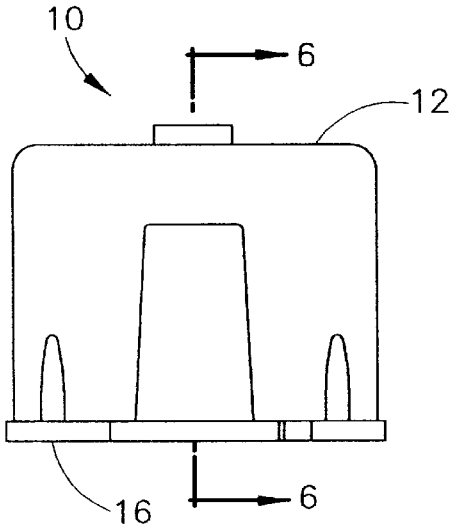
FIG. 5 is a side view of the protective cover of FIG. 3.

FIGS. 4 and 5 show the improved protective cover 10 that is made of a unitary, molded plastic cup-shaped housing 12. Such a construction allows for easy and inexpensive construction of the protective cover 10. The housing 12 has generally cylindrical inside walls that correspond in size and shape to the generally cylindrical body of the receptacle 11. The inside diameter of the housing 12 is approximately the same as the outside diameter of the receptacle 11 so that a friction fit is achieved when the cover 10 and the receptacle 11 are assembled.

As best seen in FIG. 4, a slot or keyway 14 in the inner wall of the housing 12 extends longitudinally from the open end of the housing 12 to the integral closed end of the housing 12. The slot 14 receives the corresponding orientation key on the receptacle 11 when the protective cover 10 and the receptacle 11 are assembled. A plurality of tabs 16 extend outwardly from the circumference of the open end of the housing 12. The tabs 16 allow for grasping the protective cover 10 when assembling or disassembling the protective cover 10 and the receptacle 11. At least one of the tabs 16 contains hole 20 for receiving one end of the tether 22. In the preferred embodiment, the tether 22 is connected at one end to the protective cover by inserting the first end of the tether 22 through the hole 20 and tying the first end so that the tether is secured to the protective cover 10. Other conventional means of securing the first end of the tether 22 to the protective cover 10 may be used. The second end of the tether 22 is secured by any conventional means to any object on the trailer that can support the weight of the receptacle 11 and the protective cover 10 so that the tether 22 can be easily secured and released. In the preferred embodiment, the second end of the tether 22 is releasably attached to the trailer hitch assembly.

Figure 6:
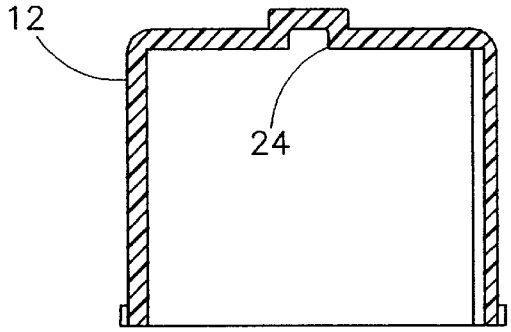
FIG. 6 is a sectional view taken substantially along lines 6—6 in FIG. 5.

As best seen in FIGS. 5 and 6, the closed end of the housing 12 has a small recess 24 in the inside of the closed end of the housing 12 to receive a corresponding additional terminal 6 protruding from the electrical connector receptacle 11. The size and location of the recess 24 corresponds to the size and location of the receptacle's 11 additional terminal 6 protruding nub so that the terminal 6 seats in the recess 24 when the cover 10 and the receptacle 11 are assembled.

In operation, when the receptacle 11 is disengaged from the associated electrical plug connected to the prime mover vehicle, such as a car or a truck, the open end of the protective cover 10 is simply fitted over the receptacle 11. The open end of the protective cover 10 must be oriented relative to the receptacle 11 so that the slot 14 is in alignment with the corresponding orientation key 4 of the receptacle 11. The receptacle 11 is then axially inserted into the protective cover 10 so that the slot 14 receives the orienting key 4 and the recess 24 receives the terminal 6. The user may grasp the tabs 16 to aid in the insertion or withdrawal of the receptacle 11 into or from the cover 10. Once assembled, the friction fit between the cover 10 and the receptacle 11 prevents unintentional disengagement of the cover 10 and the receptacle 11.

To further prevent the exposure of the receptacle 11 to environmental conditions, the first end of the tether 22 is connected to the cover 10. In the preferred embodiment, the tether 22 is attached to the cover 10 by inserting the first end of the tether 22 through a hole 20 on one of the tabs 16 and tying the tether 22 to the tab 16. The tether 22, however, can be secured to the cover 10 by any conventional means. The second end of the tether 22 is then releasably secured to the hitch assembly of the trailer so that the assembled cover 10 and receptacle 11 is suspended above the ground thereby preventing moisture and other foreign objects from entering the recesses 8 of the receptacle 11.

Certain modifications and improvements will occur to those skilled in the art upon a reading of the foregoing description. By way of example, any conventional means can be used to attach the tether 22 to the assembled cover 10 and receptacle 11 and to the trailer hitch assembly. The tether 22 also can be secured to any nearby stationary object that is capable of supporting the weight of the assembly of the cover 10 and the receptacle 11. The cover 10 can be made of any material that is capable of protecting the receptacle 11 from environmental conditions.

It should be understood that all such modifications and improvements have been deleted herein for the sake of conciseness and readability but are properly within the scope of the following claims.

I claim:

1. A protective cover for a multiple-pin electrical connector receptacle of the type used to connect a trailer and a prime mover vehicle, the receptacle having a generally cylindrical body having at least one longitudinally extending orientation key protruding outwardly from the cylindrical body and a generally flat end having multiple electrical connecting elements recessed therein and an additional terminal protruding therefrom, the cover comprising:

a) a cup-shaped housing having an open end and a closed end and a cylindrical wall therebetween, the cylindrical wall having an inner surface and an outer surface, the diameters of the inner surface of the cylindrical wall and the cylindrical body being so related so that when assembled a friction fit exists therebetween to provide the principal means for retaining the cover in assembled relation to the receptacle;

b) a longitudinally extending slot in the inner surface of the cylindrical wall of the housing for receiving the orientation key when the cover is assembled with the receptacle;

c) a recess formed in the inside surface of the closed end of the housing for receiving the additional protruding terminal of the receptacle when the cover is assembled with the receptacle; and d) a plurality of spaced tabs adjacent to the open end of the housing and extending outwardly from the outer surface of the cylindrical wall for aiding in the assembly and disassembly of the cover and the receptacle.

2. The cover of claim 1, further including at least one hole in at least one of the plurality of spaced tabs.

3. The cover of claim 2, further including a tether with a first end and a second end, the first end being connected to the cup-shaped housing at the at least one hole and the second end being connected to the trailer for suspending the receptacle above the ground.

4. The cover of claim 1, wherein the housing is of a unitary molded plastic construction allowing for simple and inexpensive manufacture.

* * * * *